US011679850B2

(12) United States Patent
Wistedt et al.

(10) Patent No.: US 11,679,850 B2
(45) Date of Patent: Jun. 20, 2023

(54) SYSTEM FOR ATTACHING A DEVICE TO AN OBJECT, AND ASSOCIATED SYSTEM FOR DEPLOYING THE DEVICE

(71) Applicant: Saab Dynamics AB, Linköping (SE)

(72) Inventors: Åke Wistedt, Linköping (SE); Ernst Olivier Schneider, Linköping (SE)

(73) Assignee: Saab Dynamics AB, Linköping (SE)

( * ) Notice: Subject to any disclaimer, the term of this patent is extended or adjusted under 35 U.S.C. 154(b) by 0 days.

(21) Appl. No.: 17/255,832

(22) PCT Filed: Jul. 2, 2019

(86) PCT No.: PCT/EP2019/067712
§ 371 (c)(1),
(2) Date: Dec. 23, 2020

(87) PCT Pub. No.: WO2020/007849
PCT Pub. Date: Jan. 9, 2020

(65) Prior Publication Data

US 2021/0362815 A1 Nov. 25, 2021

(30) Foreign Application Priority Data

Jul. 2, 2018 (EP) ..... 18446501

(51) Int. Cl.
*B63G 7/02* (2006.01)
*B63G 8/00* (2006.01)
*B63G 7/00* (2006.01)

(52) U.S. Cl.
CPC ..... *B63G 7/02* (2013.01); *B63G 8/001* (2013.01); *B63G 2007/005* (2013.01); *B63G 2008/005* (2013.01)

(58) Field of Classification Search
CPC ..... F42D 5/04; B63G 7/02
See application file for complete search history.

(56) References Cited

U.S. PATENT DOCUMENTS 5,661,258 A * 8/1997 Garcia ..... B63G 7/02 89/1.13
2013/0125741 A1 9/2013 Lambertus

FOREIGN PATENT DOCUMENTS

EP 3179202 A1 6/2017
EP 3318833 A2 5/2018
(Continued)

OTHER PUBLICATIONS

PCT International Search Report and Written Opinion dated Sep. 27, 2019 for Intl. App. No. PCT/EP2019/067712, from which the instant application is based, 9 pgs.

*Primary Examiner* — Andrew Polay
(74) *Attorney, Agent, or Firm* — Fredrikson & Byron, P.A.

(57) ABSTRACT

The present invention relates to a system for attaching a device to an object, comprising: an attachment device for attaching the device to an object, the attachment device having a trigger for triggering activation of the attachment device; a releasable coupling device for releasably coupling the attachment device to a deployment system. The releasable coupling device comprising: a housing; a trigger system, configured to trigger the attachment device trigger; and a retaining system, configured to releasably retain the attachment device. The releasable coupling device is configured such that: in a first configuration, the trigger system is in a disarmed state; in a second configuration, the trigger system is in an armed state, such that movement of the attachment device relative to the housing of the releasable coupling device activates the trigger of the attachment device; and in a third configuration, the retaining system releases the attachment device. The invention is particular of use in attaching an ordnance clearance charge to underwater ord-
(Continued)

nance. The invention further relates to an unmanned underwater vehicle comprising such an attaching system.

15 Claims, 10 Drawing Sheets

(56) References Cited

FOREIGN PATENT DOCUMENTS

| | | | | |
|---|---|---|---|---|
| FR | 2882339 A1 * | 8/2006 | ..... | B63G 7/02 |
| GB | 2234203 A | 1/1991 | | |

* cited by examiner

SYSTEM FOR ATTACHING A DEVICE TO AN OBJECT, AND ASSOCIATED SYSTEM FOR DEPLOYING THE DEVICE

RELATED APPLICATIONS

This application is a 35 U.S.C. 371 national stage filing from International Application No. PCT/EP2019/067712, filed Jul. 2, 2019, which claims priority to European Application No. 18446501.1, filed Jul. 2, 2018, the teachings of which are incorporated herein by reference.

The present invention relates to a system for attaching a device to an object. The invention also relates to a deployment system for deploying the device and attaching it to an object. In particular, the invention relates to a disposal charge deployment system for ordnance neutralisation and disposal.

Underwater ordnance disposal systems are known. For example, traditional mine sweeping vessels drag either lines to mechanically trigger the ordnance or a decoy to remotely trigger the ordnance for example by simulating the magnetic or acoustic signature of a vessel being targeted by the ordnance. This type of mine sweeping is dangerous as it requires the vessel to enter the area containing the ordnance. In addition, unsweepable ordnance has been developed which prevents the use of such a system.

Other types of ordnance disposal systems are known, and enable remote, i.e. remote from a vessel such as a mine countermeasures vessel (MCMV), operation. Examples of such known systems are diver placed charges, remotely operated single charge systems, and multiple charge deployment systems.

The diver placed charges may be attached to the ordnance by a variety of means such as a rope, or mechanical fixings, etc and can be triggered by a variety of means such as a timer, or a flash exploder. Diver placed charges are inherently dangerous for the diver, and time consuming to clear an area containing the ordnance to be disposed. In addition, they are depth limited, preventing use in deep water.

Remotely operated single charge systems provide the advantage over diver placed charges that a human is not required to enter the area containing the ordnance. A number of remotely operated single charge systems are known. Such systems may have an onboard target identification system, or they may be controlled from a surface vessel. These systems may require an identification vehicle to be used to identify the ordnance before releasing the charge system. Where the system has a target identification system onboard, there may be the need for significant time to be spent to train the system to identify ordnance. As such, the single charge systems are time consuming, and may not correctly identify ordnance. Furthermore, once launched from a vessel in an armed state, the charge cannot be recovered safely and so is always triggered, but due to the difficulties associated with identifying ordnance may sometimes neutralise non-ordnance targets. This leads to a high attrition rate of the charges, which leads to operational problems. Due to the complete destruction of the vehicles associated with such systems at neutralisation, the operational costs are high.

A known remotely operated multiple charge deployment system enables more than one ordnance to be targeted in a single sortie. The known system enables more than one charge to be dropped separately, each charge being dropped in the vicinity of a different ordnance to be neutralised. The known multiple charge deployment systems utilise a blast charge which is operationally limited in its employment. As used herein, the term 'sortie' refers to a single launch of a charge deployment system from a MCMV.

Other known systems provide a remotely operated vehicle which carries a single charge to be deployed. The system uses simultaneous activation of an attachment device to attach the charge to ordnance, and release of the charge from the underwater vehicle carrying the charge. This can be undesirable since when the attachment device fails to securely attach the charge to the ordnance, the charge is lost and difficult if not impossible to recover.

It is therefore an object of the present invention to provide a system for ordnance neutralisation which reduces the cost, and time, associated with ordnance neutralisation, while improving accuracy and safety. It is a further object of the present invention to provide an effective system for attaching a device, such as a charge device, to an object, such as ordnance.

According to a first aspect of the present invention, there is provided a system for attaching a device to an object, comprising: an attachment device for attaching the device to an object, the attachment device having a trigger for triggering activation of the attachment device; and a releasable coupling device for releasably coupling the attachment device to a deployment system. The releasable coupling device comprises: a housing; a trigger system, configured to trigger the attachment device trigger; and a retaining system, configured to releasably retain the attachment device. The releasable coupling device is configured such that: in a first configuration, the trigger system is in a disarmed state; in a second configuration, the trigger system is in an armed state, such that movement of the attachment device relative to the housing of the releasable coupling device activates the trigger of the attachment device; and in a third configuration, the retaining system releases the attachment device.

Advantageously, by providing a system having a releasable coupling device which can be placed in these three configurations, a safe system is provided which cannot be accidentally triggered, and in addition it can be ensured that a secure attachment of the object to its target has been made before release.

In a preferred embodiment, the object to which the device is to be attached is ordnance, more preferably underwater ordnance. The term 'ordnance' includes: underwater mines, which include ground mines, in-volume mines, floating mines, shallow moored mines, and drifting mines; modern or historical underwater and land based ordnance, which include iron bombs, depth charges, torpedoes, and artillery shells; underwater and land based, improvised explosive devices (IEDs).

In this preferred embodiment, the device to be attached to the object comprises a clearance charge for neutralising the ordnance. The term 'neutralisation' refers to any means of disabling and/or disposing of ordnance, and includes complete high-order detonation, partial-high order detonation, and low order detonation such as disabling the ordnance firing mechanism or disrupting the ordnance firing train, and includes deflagration. The clearance charge may be any one of a plurality of explosive charge types to be used in dependence on the type of ordnance to be neutralised. The plurality of explosive charge types may include: a shaped charge; a blast charge; and an ordnance firing mechanism immunisation charge.

The device may be further configured such that the trigger system comprises a trigger portion, slidable, relative to the housing, from a first position, in which the releasable coupling device is in the first configuration, to a second position, in which releasable coupling device is in the second configuration. Providing a slidable trigger portion advantageously enables easier control of the system between the disarmed and armed states. The trigger system may further comprise an actuation portion, slidable, relative to the housing, between a first position, in which the releasable coupling device is in the first configuration, a second position, in which the releasable coupling device is in the second configuration, and a third position, in which releasable coupling device is in the third configuration. Advantageously, further configuring the slidable trigger portion in this manner enables easier control of the system between the disarmed, armed and release states.

The trigger portion is preferably slidable, relative to the actuation portion, from a first position, in which the releasable coupling device is in the first and second configurations, and a second position, in which the releasable coupling device is in the third configuration. In this way, providing a slidable trigger portion, relative to the actuation portion, enables a simpler control environment, requiring only one input. Preferably, the trigger portion is resiliently biased towards the first position relative to the actuation portion. As such, this enables the trigger portion to retract upon the actuation portion moving to the release configuration. The trigger portion is preferably resiliently biased by a resilient element. The resilient element is preferably a spring, such as a helical spring formed of metal, such as spring steel.

The actuation portion may comprise a visual indicator arranged to indicate when the actuation portion is in its first position. Advantageously, this enables the user to know that it is safe to insert an attachment device, because the system is in the disarmed configuration.

The actuation portion is preferably configured to be hydraulically moved from the first position to the second position. Advantageously, providing hydraulically actuation enables accurate and precise control, reducing the risk of unintentional arming and/or release. The actuation portion is preferably formed as a piston, housed within a cylinder formed in the housing. The piston is preferably sealed within the cylinder. The seal may be formed by an o-ring or the like.

In this embodiment, where the actuation portion is configured to be moved hydraulically, the system preferably comprises a source of pressurised hydraulic fluid. The source of pressurised hydraulic fluid may be a hydraulic pump, and/or an accumulator. The system preferably further comprises control valves, configured to enable a pre-defined volume of hydraulic fluid to flow to the actuation portion to move the actuation portion from the first position to the second position.

Alternatively, the actuation portion may be configured to be mechanically moved from the first position to the second position. In this embodiment, the system may comprise at least one cable, configured to act on the actuation portion to move it from the first position to the second position. The cable is preferably a Bowden cable comprising a cable within a sheath, one end of the sheath being attached to the housing of the releasable coupling device. The cable preferably passes over a cable guide, such that the cable is configured to cause the actuation portion to move in a direction opposite to the direction of cable movement. The cable may be actuated by a servo-motor, the servo-motor preferably being attached to a portion of system remote from the attachment device, for example on a remotely operated vehicle supporting the housing of the system.

In a further alternative, the system comprises a linear actuator configured to mechanically move the actuation portion from the first position to the second position. The linear actuator may comprise: a rotatable threaded rod; and, a motor for rotating the threaded rod, wherein the actuation portion is coupled to the threaded rod. The motor may be a stepper-motor.

The retaining system preferably comprises at least two retaining arms, each arm having a distal end and a proximal end, the arms configured to pivot about the proximal ends from a first position in which the distal ends engage and retain the attachment device, to a second position in which the distal ends release the attachment device. The retaining system more preferably comprises at least three retaining arms, even more preferably four retaining arms. Advantageously, providing pivotable retaining arms enable the attachment device to be retained and released more easily. The distal end of each retaining arm may comprise a hook configured to engage with a recess provided in an outer surface of the attachment device. The use of hooks at the ends of the arms improves the connection, and therefore reduces the possibility of unintentional release. The recess provided in the outer surface of the attachment device may be an annular recess.

Alternatively, the distal end of each retaining arm may comprise a recess, the outer surface of the attachment device comprising a corresponding protrusion configured to engage within the recess of each retaining arm.

In an alternative embodiment, the retaining system may comprise a plurality of retaining pins, radially slidable from a first position in which the pins engage and retain the attachment device, to a second position in which the pins release the attachment device. In this embodiment, the pins may engage with corresponding holes within the outer surface of the attachment device. The pins may be resiliently biased towards the first position.

In a yet further alternative, the retaining system may comprise an electromagnet, configured to act on a magnetic portion provided in the attachment device. The electromagnet is preferably controllable such that upon activation, the attachment device is released. As will be appreciated, the retaining system may comprise any suitable means for releasably retaining the attachment device.

The retaining system preferably further comprises a trigger sleeve configured to pivotably retain the proximal ends of the at least two retaining arms, the trigger sleeve being slidable, relative to the housing, between a first position and a second position, such that upon the releasable coupling device being in the second configuration movement of the trigger sleeve from the first position to the second position causes the trigger portion to activate the trigger of the attachment device. Providing a trigger sleeve enables simple activation of the attachment device trigger, while enabling the attachment device to be more easily retained within the system. The trigger sleeve is preferably resiliently biased towards the first position. The trigger sleeve is preferably resiliently biased by at least one resilient element. The or each resilient element may be a spring, such as a helical spring formed of metal, such as spring steel. In this way, unintentional triggering is advantageously prevented by ensuring the system is biased towards a configuration where the trigger portion is not engaged with the attachment device trigger.

The trigger sleeve may further comprise at least one stop, configured to at least prevent further movement in a direction from the second position towards the first position upon the sleeve being in the first position. The at least one stop may be further configured to prevent further movement in a direction from the first position towards the second position upon the sleeve being in the second position.

The retaining system preferably further comprises a release sleeve slidable, relative to the trigger sleeve, from a first position in which the release sleeve acts on the at least two retaining arms to maintain the at least two retaining arms in their first position, to a second position in which the at least two retaining arms are in their second position. Providing a retaining sleeve advantageously enables simple control of the system between a configuration where the attachment device is retained, and a configuration where it is released. The actuation portion may be configured such that, upon the actuation portion sliding from its second position to its third position, it acts on the release sleeve to move the release sleeve from its first position to its second position. Interaction between the actuation portion and the release sleeve may advantageously enable fewer components.

The release sleeve may comprise at least two linear cam surfaces, and adjacent each distal end of the at least two retaining arms is provided a follower, each linear cam surface being configured to act on a corresponding follower of a retaining arm, such that upon the release sleeve moving from its first position to its second position each retaining arm is moved from its first position to its second position.

In the embodiment comprising retaining pins, each pin may comprise a follower, wherein each linear cam surface is configured to act on a corresponding retaining pin follower to move the retaining pins out of engagement with the attachment device.

The release sleeve may further comprise at least one stop, configured to at least prevent further movement in a direction from the first position towards the second position upon the sleeve being in the second position. The stop may further act as the indicator, configured to indicate to a user upon the release sleeve being in the second position.

The attachment device may include: an explosive powered captured-fastener gun; a magnet; a suction device; and chemical adhesion. The suction device may be a suction cup. The chemical adhesive may be a cyanoacrylate glue. The cyanoacrylate glue may be in the form of a gel. In a preferred embodiment the attachment means is an explosive powered captured-fastener gun. The power-actuated captured fixing gun, may be a nail gun or the like configured to ensure that upon firing the nail gun, the nail remains partially within the attachment device to both ensure the device is attached to the object and to reduce the risk of injury upon accidental firing of the attachment device.

The housing may comprise at least one resilient member, configured to couple the housing to a further device, such as an unmanned underwater vehicle. The at least one resilient member may be a resilient bushing, such as a rubber bushing, or a spring, such as a helical spring formed of metal, such as spring steel.

In the preferred embodiment, where the device to be attached to ordnance comprises a clearance charge, the clearance charge may further comprise a receiver for receiving a detonation signal. The receiver may be configured to receive a radio frequency signal, or an acoustic signal. Alternatively, each clearance charge comprises a timer configured to detonate the explosive after a pre-determined period of time. The clearance charge may comprise a float comprising the receiver, the float being configured to float to the surface after the charge is deployed underwater. The float may be coupled to the explosive charge by a shock tube detonator, such as a NONEL shock tube detonator. When the float is released from the charge system, the shock tube detonator spools from the float enabling the float to reach the surface without being hindered by the shock tube becoming tangled or caught up. The length of shock tube detonator provided may be between about 10 m and about 300 m, or more depending on the requirements of the situation. As will be appreciated, sufficient shock tube is provided to ensure the float can reach the surface of the water in which the ordnance is located.

In a preferred embodiment, the float may be coupled to the explosive charge by an electrical cable, the electrical cable being configured to transmit a detonation signal to a detonator provided adjacent the explosive charge.

In one embodiment, the float is configured to float to the surface after a pre-determined period of time. The pre-determined period of time can preferably be programmed into the charge system immediately prior to launching the deployment system on a sortie. The pre-determined period of time is preferably between about 12 hours and about 672 hours, more preferably between about 12 hours and about 144 hours. In this way, and where necessary, the charge system can be deployed in a covert manner, and then detonated more or less immediately after the float is released to the surface to receive a detonation signal at a later time.

The float may comprise a scuttling charge configured to scuttle the float after detonating the explosive charge. The scuttling charge is preferably detonated after a short time delay from the primary detonation of the explosive charge in the charge system. The scuttling charge may also be detonated using a shock tube detonator, such as a NONEL shock tube detonator. The delay between primary detonation and the detonation of the scuttling charge may be between about 5 ms and about 50 ms, more preferably about 10 ms. The scuttling charge may be PE-4, or any other suitable plastic explosive. By scuttling the float there is a reduced risk of arisings being left at the surface after neutralisation of the ordnance.

In an alternative embodiment, each clearance charge comprises a timer configured to detonate the explosive after a pre-determined period of time. As will be appreciated, in this embodiment a transmitter is not required, and so a simplified version of the system can be provided.

According to a further aspect of the present invention, there is provided an unmanned underwater vehicle comprising a system for attaching a device to an object as described herein. The system advantageously enables a clearance charge to be deployed and triggered without destroying the unmanned vehicle, and so the cost of operation may be reduced as compared to known charge deployment systems. The vehicle may be a remotely operated vehicle (ROV). The vehicle may be an autonomous vehicle. The vehicle is preferably an underwater vehicle.

The unmanned vehicle preferably further comprises a camera system, the camera system comprising: a camera; and a transmitter for transmitting camera images to a remote location, the camera being configured to enable identification of ordnance prior to deploying a charge. The system is advantageously designed to enable identification of the target before the decision is taken to engage and so there is no unnecessary expenditure of neutralisation charges on unidentified contacts unlike the known disposal systems. This may significantly reduce charge attrition rate and thereby increases operational efficiency.

The unmanned vehicle preferably further comprises a navigation system configured to enable the location of the unmanned vehicle to be determined.

The unmanned vehicle preferably further comprises a sonar system configured to detect ordnance.

The unmanned vehicle may be operated from a MCMV or an unmanned surface vehicle. The unmanned vehicle may be particularly suited to deployment from ashore from a containerised module or from a craft of opportunity. In any one of these operational configurations one of its major advantages is the expeditionary nature of its operation. The charge is preferably attached to the ordnance by the ROV, released from its housing and is left "ready" until the predetermined firing signal is transmitted or the countdown timer is activated.

The unmanned underwater system may further comprise a transmitter for transmitting a detonation signal to the clearance charge. The transmitter may be configured to transmit a radio frequency signal, or an acoustic signal. The transmitter may be configured to operate only when it has a line of sight to the charge, and so the transmitter may be positioned up to about 14 km from the charge. Alternatively, the transmitter may be provided on a remote vessel.

In the embodiment comprising the transmitter and receiver, the transmitter is preferably configured to transmit a coded signal. Each receiver is then configured to detonate the clearance charge on receipt of a pre-determined coded signal. This enables each clearance charge to be provided with a different code to enable each clearance charge to be detonated separately.

Any feature in one aspect of the invention may be applied to other aspects of the invention, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the invention can be implemented and/or supplied and/or used independently.

The invention will be further described, by way of example only, with reference to the accompanying drawings in which.

Figure 1:
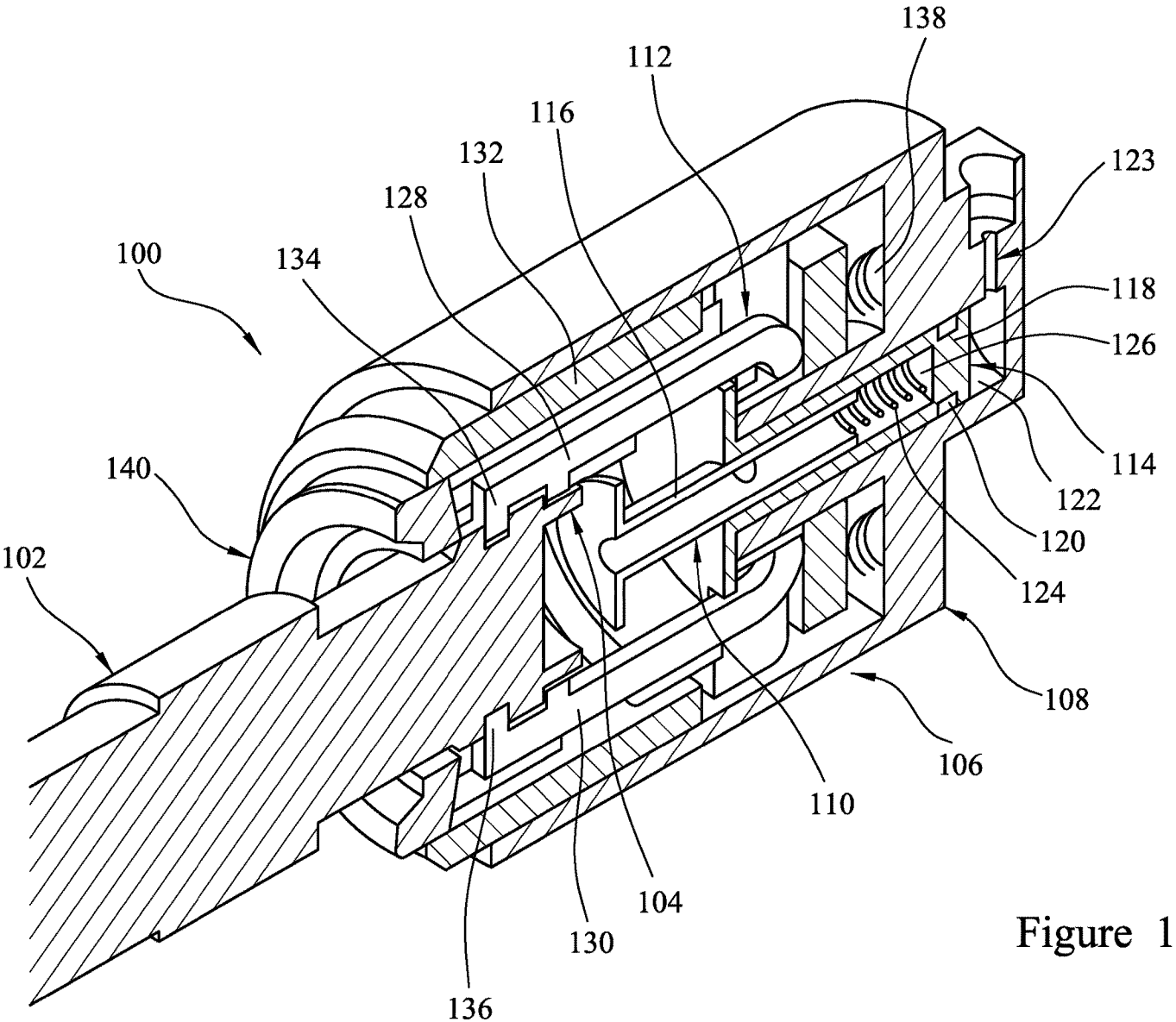
FIG. 1 shows a schematic cross-sectional perspective view of a system for attaching a device to an object according to the invention, the system in a first configuration.

FIG. 1 shows a schematic cross-sectional perspective view of a system 100 for attaching a device 102 to an object according to the invention. The device 102, in this example, comprises a trigger activated nail gun, the trigger extending from the back face 104 of the device 102. Further details of the device 102 are described below. A releasable coupling device 106 of the system 100 is referred to below as a trigger and release unit. The trigger and release unit 106 comprises a housing 108 configured to be attached to a vehicle (not shown) for delivering the device 102 to its intended location. The vehicle may be an unmanned underwater vehicle such as a remotely operated vehicle (ROV).

The housing 108 of the trigger and release unit 106 houses a trigger system 110, configured to trigger the attachment device 102 trigger. The housing 108 further houses a retaining system 112, configured to releasably retain the attachment device 102 within the housing.

The trigger system 110 comprises an actuation portion 114 and a trigger portion 116. The actuation portion 114 comprises a piston 118 sealed by an o-ring 120 within a cylinder 122 within the housing. A hydraulic fluid inlet 123 is provided in the housing to allow hydraulic fluid to be pumped into the cylinder 122 to act on the piston 118 of the actuation portion 114. The piston 118 of the actuation portion 114 is hollow, and configured to slidably receive the trigger portion 116. A resilient spring 124 is provided which acts on the end face 126 of the hollow portion of the actuation portion 114, and extends within a hollow portion of the trigger portion 116 and acts on a pin (not shown) located transverse to the longitudinal axis of the trigger portion 116. The spring 124 biases the trigger portion towards the attachment device 102, and the trigger thereof.

The retaining system 112 comprises four retaining arms 128, 130 (only two shown) pivotably mounted within a trigger sleeve 132. The retaining arms 128, 130 are pivotable from a first position (as shown) to a second position. The distal end of each retaining arm 128, 130 comprises a protrusion 134, 136. Upon the retaining arms being in the first position, the protrusions 134, 136 are configured to engage with an annular recess provided within the outer surface of the device 102. The trigger sleeve 132 is slidable within the housing from a first position (shown) to a second position. A resilient spring 138 is provided between an end face of the trigger sleeve and the housing to bias the trigger sleeve towards the first position.

The retaining system further comprises a release sleeve 140. The release sleeve is slidable within the trigger sleeve 132 from a first position in which the distal ends of the retaining arms are maintained in their first position, to a second position in which the distal ends of the retaining arms are rotated to their second position.

Figure 2:
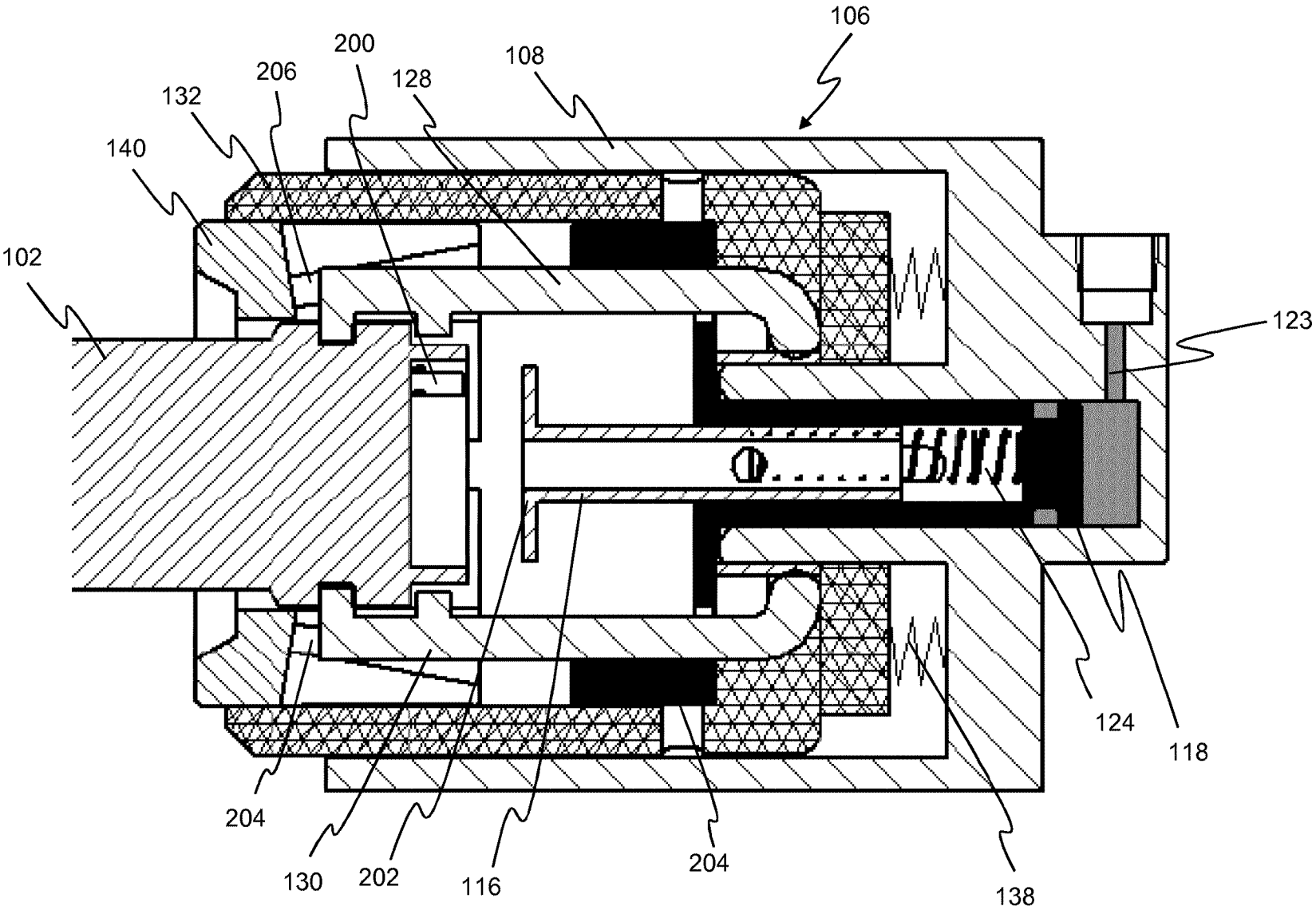
FIG. 2 shows a schematic cross-sectional view of the system shown in FIG. 1.
Figure 3:
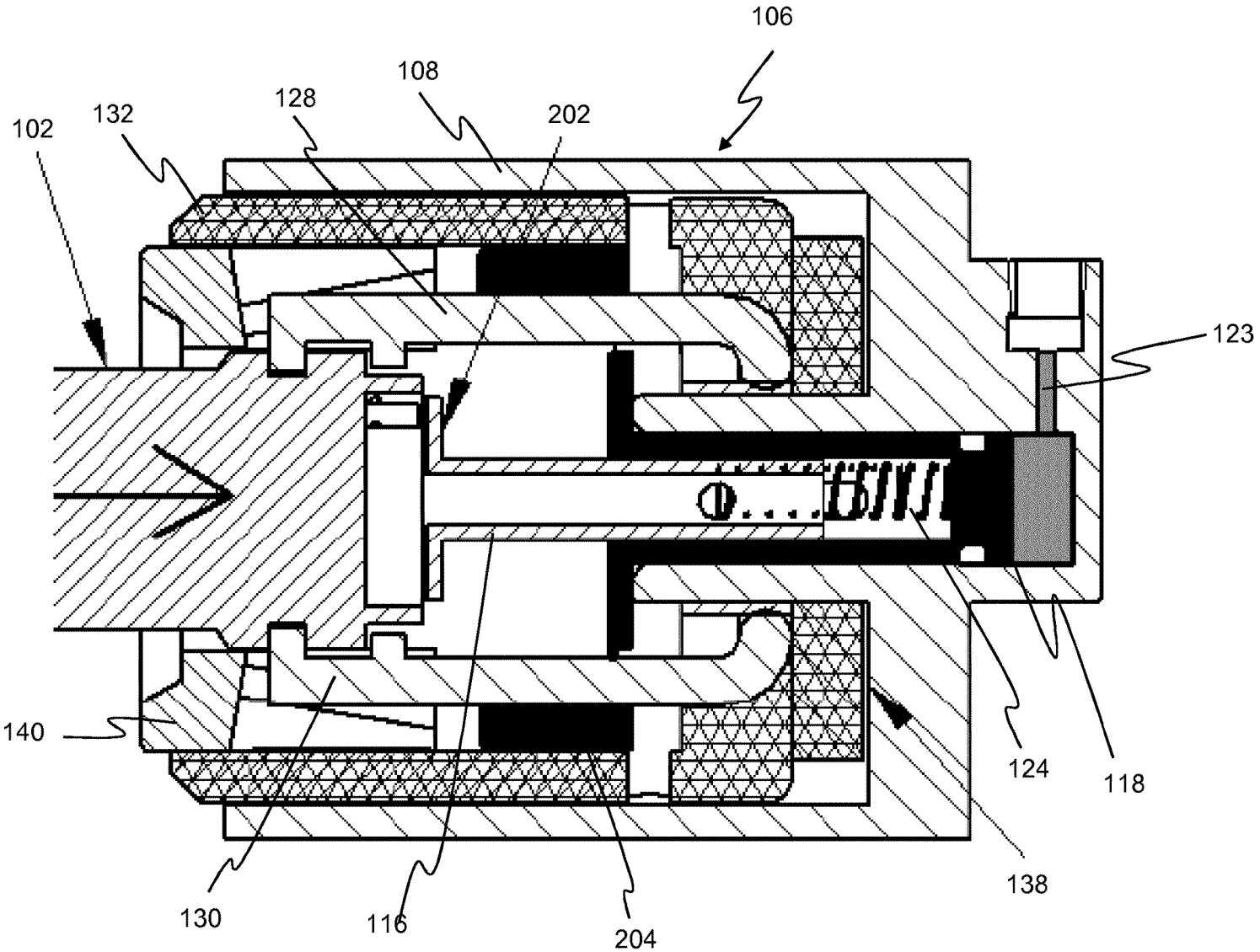
FIG. 3 shows a schematic cross-sectional view of the system shown in FIG. 1, the system in an alternative arrangement.
Figure 4:
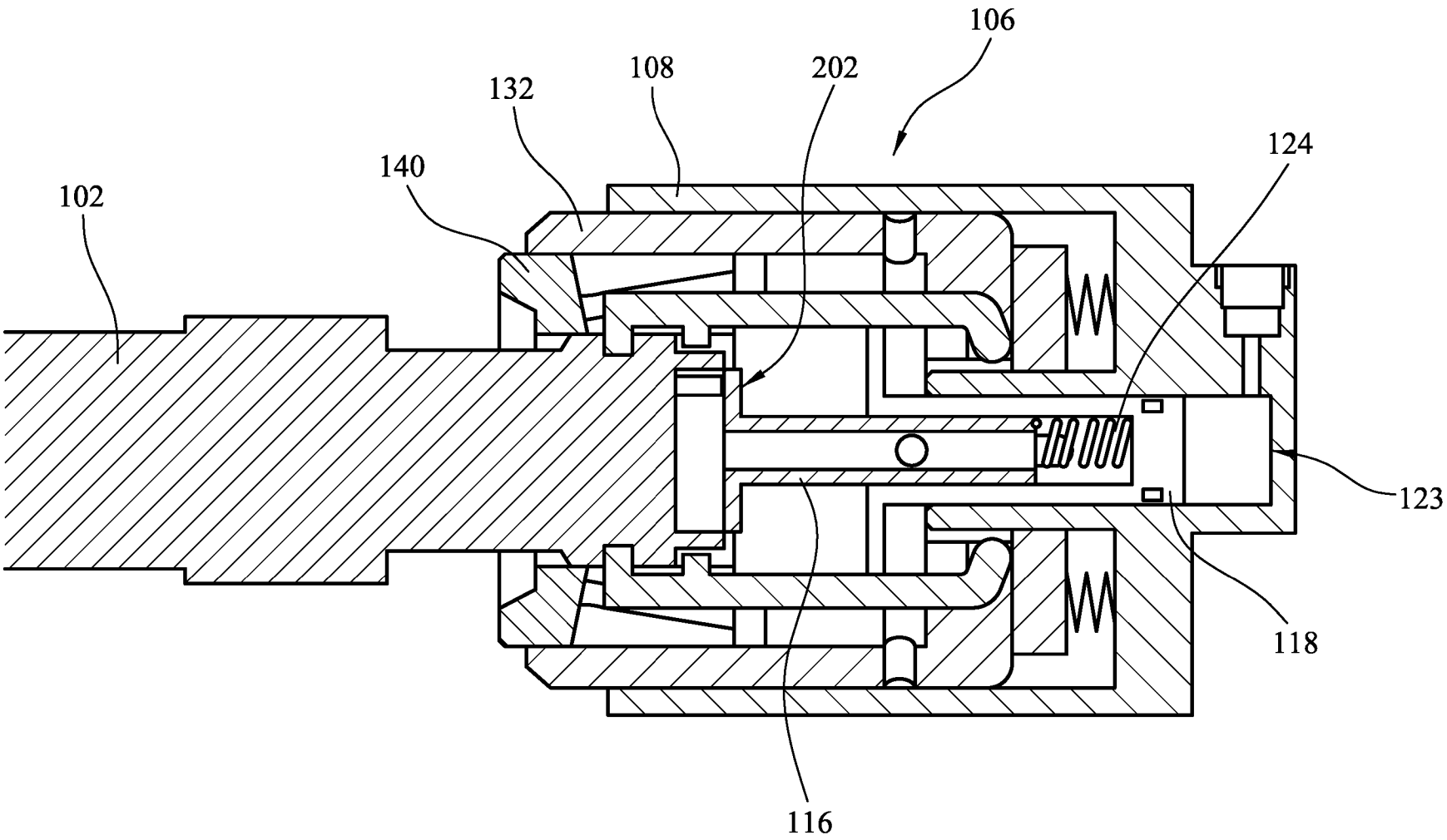
FIG. 4 shows a schematic cross-sectional view of the system shown in FIG. 1, the system in a second configuration.
Figure 5:
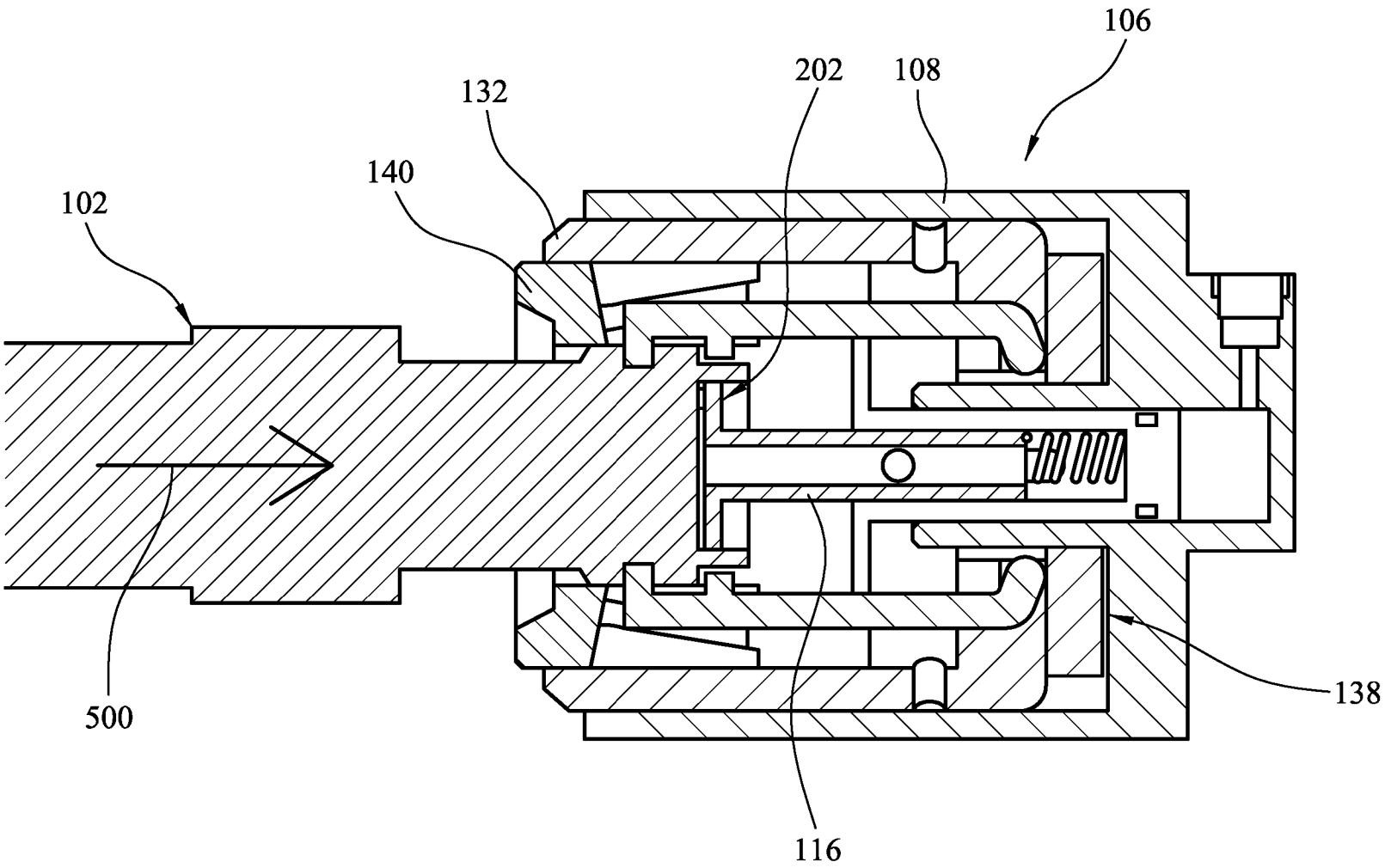
FIG. 5 shows a schematic cross-sectional view of the system shown in FIG. 4, the system in an alternative arrangement.

Further details of the trigger and release unit 106 will now be described with reference to FIG. 2. The activation trigger 200 of the attachment device 102 can now be seen extending from the back face of the attachment device. The activation trigger 200 is operated by an external force pushing the trigger into the attachment device.

As can also be seen, the trigger portion 116 is formed of a hollow cylinder having a flange 202 at a distal end. The flange is configured to engage with the activation trigger 200 as will be described in detail below. The flange 202 is substantially circular.

The actuation portion 114 comprises both the actuation piston 118 and a further cylindrical portion 204 provided at a distal end of the cylindrical piston 118. The cylindrical portion 204 is configured to act on the release sleeve 140, to cause it to slide from the first position to the second position.

The release sleeve 140 can now be seen to comprise a plurality of inclined channels 204, 206, each configured to engage with corresponding pins provided at the distal ends of the retaining arms 128, 130. The inclined channels form linear cam surfaces, the pins being followers, which cause the retaining arms 128, 130 to rotate away from engagement with the recess of the attachment device 102 as the release sleeve is moved from the first position to the second position.

Operation of the trigger and release unit 106 will now be described with reference to FIGS. 2 to 7. In FIG. 2, the trigger and release unit 106 is in a first, unarmed, configuration. In this first configuration, the actuation portion 118 is in a first position whereby the trigger portion 116 and the flange 202 are spaced from the activation trigger 200. In this unarmed configuration, relative movement of the attachment device 102 into the housing cannot cause the flange 200 to act upon, and trigger, the activation trigger 200. This can be seen in FIG. 3, where the attachment device 102, together with the trigger sleeve 132 has been pushed into the housing (as indicated by arrow 300) and caused the springs 138 to compress. Upon release of the force pushing the attachment device 102 into the housing 108, the springs 138 return the trigger and release unit to the configuration shown in FIG. 2. As will now be appreciated, until the trigger and release unit is controllably moved into a second, armed, configuration the activation trigger 200 of the attachment device 102 cannot be triggered.

When the operator of the trigger and release unit 106 inputs a control signal to a controller (not shown) to place the trigger and release unit into a second, armed, configuration a predefined volume of hydraulic fluid is pumped through the inlet 123 into the cylinder 122. The actuation piston 1189 is thereby moved to the position shown in FIG. 4. As can be seen, the flange 200 of the trigger portion 116 now abuts the activation trigger 200, placing the trigger and release unit in the armed configuration. Now movement of the attachment device 102 in the direction of arrow 500 causes the springs 138 to compress and the flange 202 to act on the activation trigger 200 and activate the attachment device 102. It is noted that the trigger spring 124 has a spring coefficient such that the force required to compress the spring 124 is greater than the force required to activated the activation trigger 200.

Figure 6:
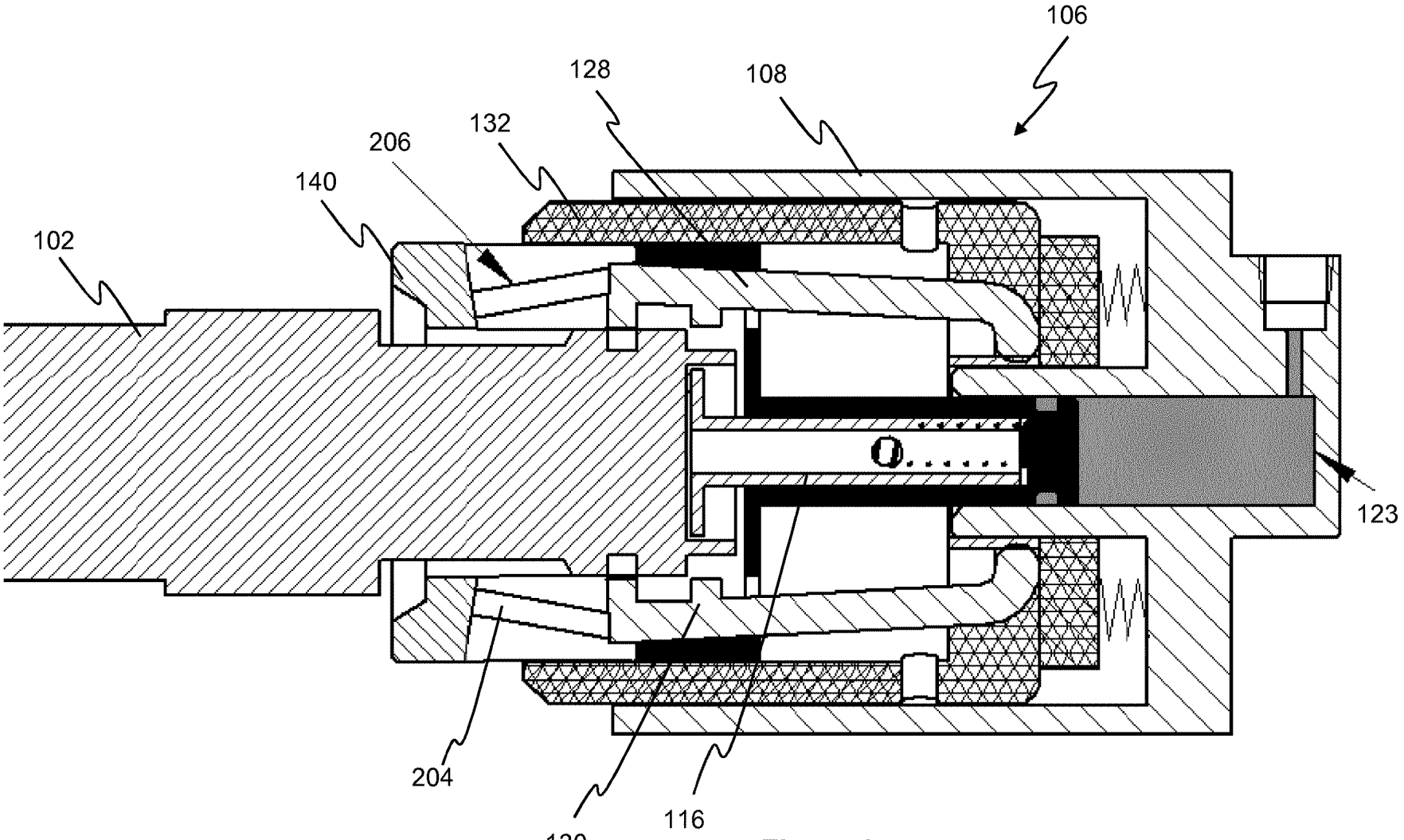
FIG. 6 shows a schematic cross-sectional view of the system shown in FIG. 1, the system in a third configuration.
Figure 7:
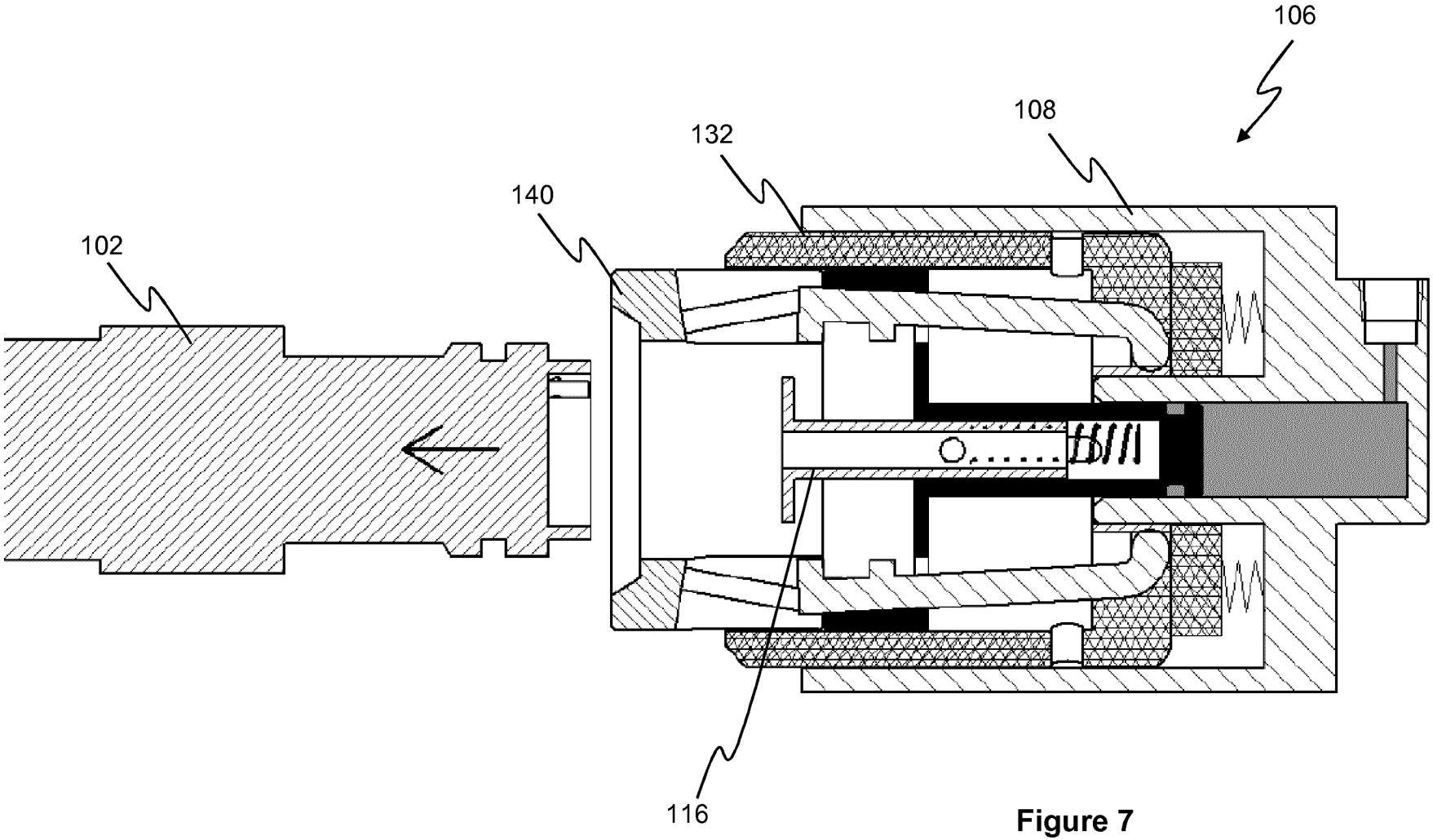
FIG. 7 shows a schematic cross-sectional view of the system shown in FIG. 6, the system in an alternative arrangement.

Once the attachment device 102 is attached to the intended object it can be released from the trigger and release unit 106. To do so, the operator of the trigger and release unit 106 inputs a control signal to a controller (not shown) to place the trigger and release unit into a third, release, configuration to pump a second predefined volume of hydraulic fluid through the inlet 123 into the cylinder 122. This causes the actuation piston 118 to move to a third position as shown in FIG. 6. In doing so, the cylindrical portion 204 acts on the release sleeve to move it to its second position thereby rotating the retaining arms 128, 130 out of engagement with the recess in the outer surface of the attachment device. In addition, the trigger spring 124 is compressed to enable the trigger portion 116 to retract into the hollow portion of the actuation portion 118. As the retaining arms disengage, the trigger spring may then act to separate the attachment device from the trigger and release unit, as shown in FIG. 7.

The trigger and release unit 106 is now in a configuration ready to receive another attachment device 102. In order to prime the trigger and release unit to receive another attachment device 102, the actuation portion 118 is moved back to its first position (as shown in FIG. 2) by removing hydraulic fluid. The attachment device 102 is then pushed into the trigger and release unit 106 which pushes the release sleeve from its second position to its first position, rotating the retaining arms into their first position, and locking the attachment device into the trigger and release unit 106.

Figure 8:
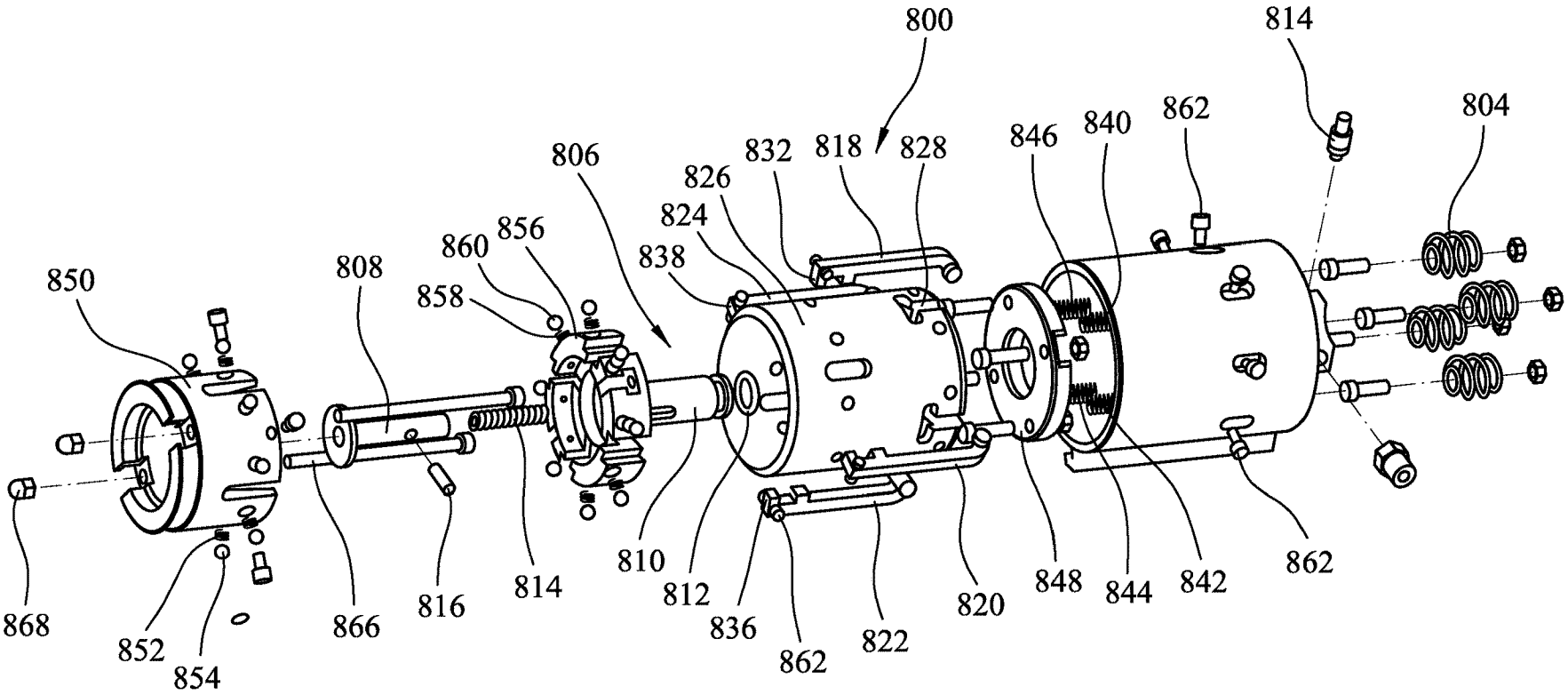
FIG. 8 shows an exploded view of an alternative embodiment of a system for attaching a device to an object according to the invention.

Another embodiment of a trigger and release unit 800 is shown in FIG. 8. As can be seen, the components of the trigger and release unit 800 are shown in an exploded view. The trigger and release unit 800 is similar to that shown in FIGS. 1 to 7, and comprises all of the features described with reference to those figures. It will also be appreciated that the trigger and release unit 800 operates in the same manner as trigger and release unit 106.

The trigger and release unit 800 comprises a housing 802 configured to be attached to a vehicle (not shown), via spring mounts 804, for delivering a device to be attached to an object to its intended location. The vehicle may be an unmanned underwater vehicle such as a remotely operated vehicle (ROV).

The housing 802 of the trigger and release unit 800 houses a trigger system, configured to trigger an attachment device trigger. The housing 800 further houses a retaining system, configured to releasably retain the attachment device within the housing 802.

The trigger system comprises an actuation portion 806 and a trigger portion 808. The actuation portion 806 comprises a piston 810 sealed by an o-ring 812 within a cylinder (not shown) within the housing 802. A hydraulic fluid inlet 814 is provided in the housing 802 to allow hydraulic fluid to be pumped into the cylinder to act on the piston 810 of the actuation portion 806. The piston 810 of the actuation portion 806 is hollow, and configured to slidably receive the trigger portion 808. The trigger portion 808 is formed of a hollow cylinder having a flange 812 at a distal end. In use, the flange is configured to engage with an activation trigger of the attachment device. The flange 812 is substantially circular.

A resilient spring 814 is provided which acts on the end face of the hollow portion of the actuation portion 806, and extends within a hollow portion of the trigger portion 808 and acts on a pin 816 located transverse to the longitudinal axis of the trigger portion 808. The spring 814 biases the trigger portion 808 towards the attachment device, and the trigger thereof.

The retaining system comprises four retaining arms 818, 820, 822, and 824 pivotably mounted within a trigger sleeve 826 in recesses 828, and 830 (recesses for retaining arms 822 and 824 not shown). The retaining arms 818, 820, 822, and 824 are pivotable from a first position to a second position. The distal end of each retaining arm 818, 820, 822, and 824 comprises a respective protrusion 832, 834 836 and 838. Upon the retaining arms being in the first position, the protrusions 832, 834 836 and 838 are configured to engage with an annular recess provided within the outer surface of the attachment device. The trigger sleeve 826 is slidable within the housing 802 from a first position to a second position. Resilient springs 840, 842, 844 and 846 are provided between an end plate 848 of the trigger sleeve and the housing to bias the trigger sleeve towards the first position.

The retaining system further comprises a release sleeve 850. The release sleeve is slidable within the trigger sleeve 826 from a first position in which the distal ends of the retaining arms are maintained in their first position, to a second position in which the distal ends of the retaining arms are rotated to their second position. The release sleeve 850 comprises a plurality of recesses in the outer, each configured to receive a spring 852 and ball bearing 854. The ball bearings are configured to form a bearing with the inner surface of the trigger sleeve 826 to enable the release sleeve 850 to smoothly slide within.

The actuation portion 806 comprises both the actuation piston 810 and a further cylindrical portion 856 provided at a distal end of the cylindrical piston 810. The cylindrical portion 856 is configured to act on the release sleeve 850, to cause it to slide from the first position to the second position. Similarly to the release sleeve, the outer surface of the cylindrical portion 856 comprises a plurality of recesses, each configured to receive a spring 858 and ball bearing 860. The ball bearings are configured to form a bearing with the inner surface of the trigger sleeve 826 to enable the cylindrical portion 856 to smoothly slide within.

The release sleeve 850 comprises a plurality of inclined channels (not shown) each configured to engage with corresponding pins 862 provided at the distal ends of the retaining arms 818, 820, 822, and 824. The inclined channels form linear cam surfaces, the pins being followers, which cause the retaining arms to rotate away from engagement with the recess of the attachment device as the release sleeve is moved from the first position to the second position.

As can be seen, a number of screws 862 are provided which screw into the outer surface of the trigger sleeve 826, and slide with slots 864. The screws and slots act to stop the trigger sleeve from moving further than designed.

Similarly, bolts 866 are provided, which in combination with nuts 868 act to prevent the release sleeve 850 from being removed from the housing. In addition, the bolts 866 act to indicate to a user which configuration the system is in. If the release sleeve is abutting the nuts 868, then the user knows that the system is in the release configuration, if the nuts are spaced from the release sleeve then the system is not in the release configuration.

The trigger and release unit 106, 800 is of particular use in attaching a clearance charge to underwater ordnance, such as mines, to be cleared. In this use case, a clearance charge is coupled to the attachment device. The clearance charge comprises a charge portion comprising a disruptor charge, such as a high-explosive. The clearance charge may also comprise a float for receiving a trigger signal to detonate the charge. In this use case, the trigger and release unit is coupled to an unmanned underwater vehicle. More than one trigger and release unit may be coupled to a single unmanned underwater vehicle to enable more than one ordnance to be cleared in any one sortie.

Figure 9:
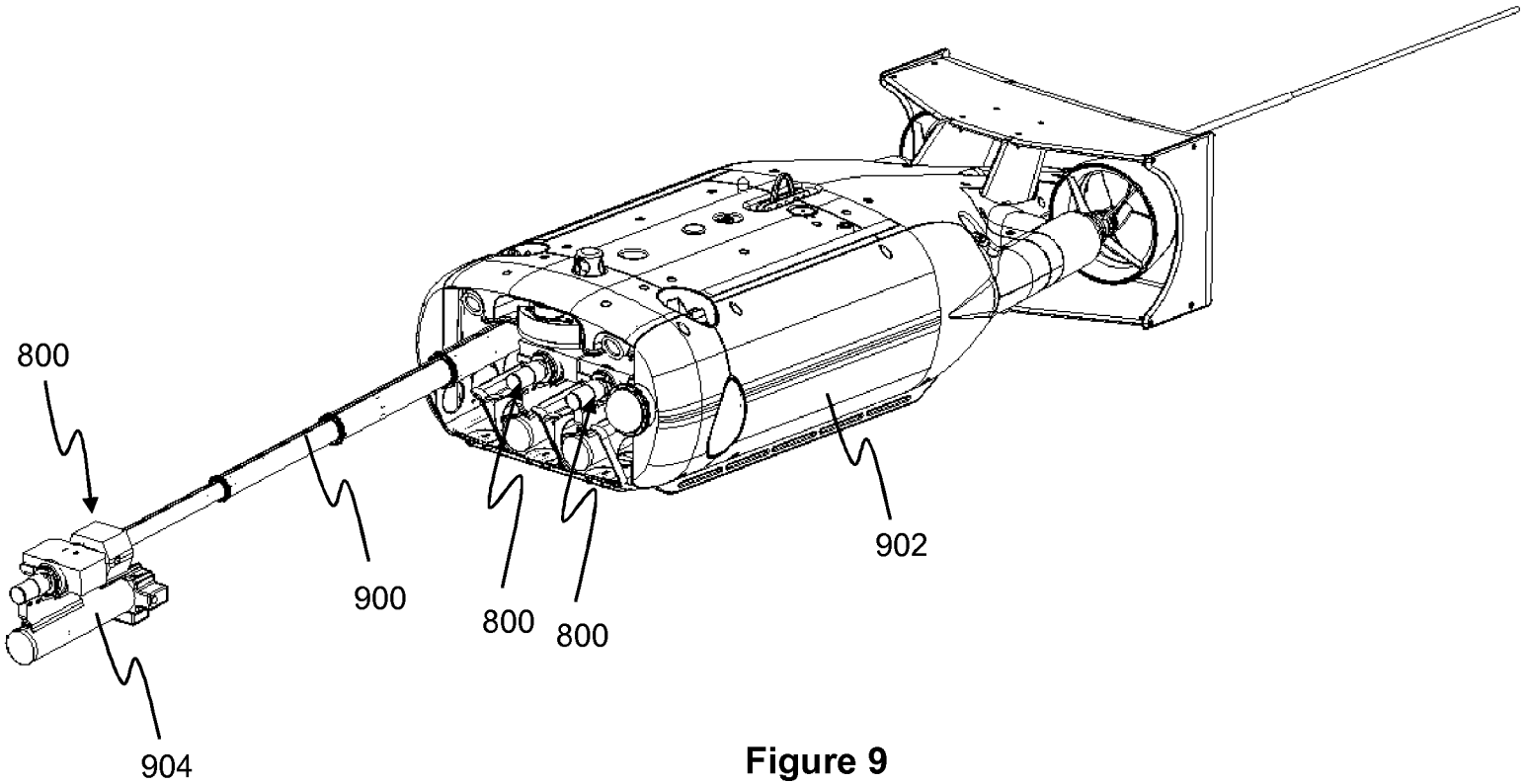
FIG. 9 shows a perspective view of a system for attaching a device to an object according to the invention coupled to an unmanned underwater vehicle.
Figure 10B:
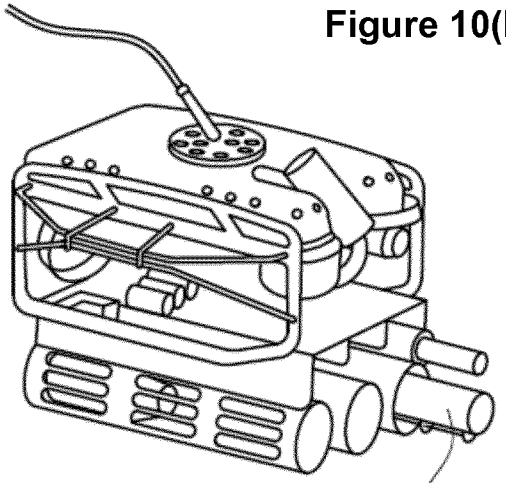
FIG. 10 show a view of an alternative system for attaching a device to an object according to the invention coupled to an alternative unmanned vehicle.
Figure 10A:
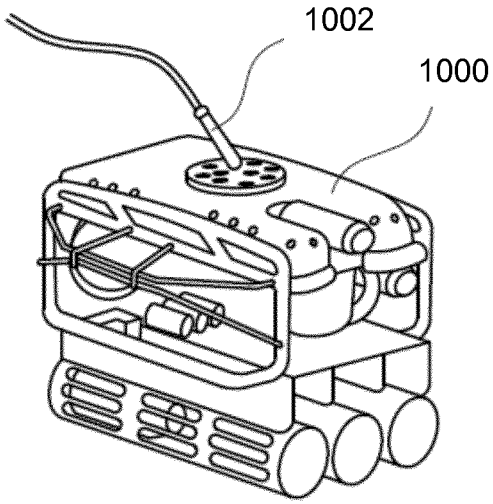
Figure 10C:
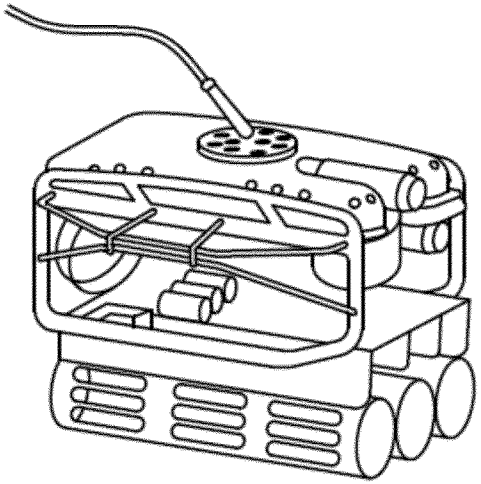
Figure 10D:
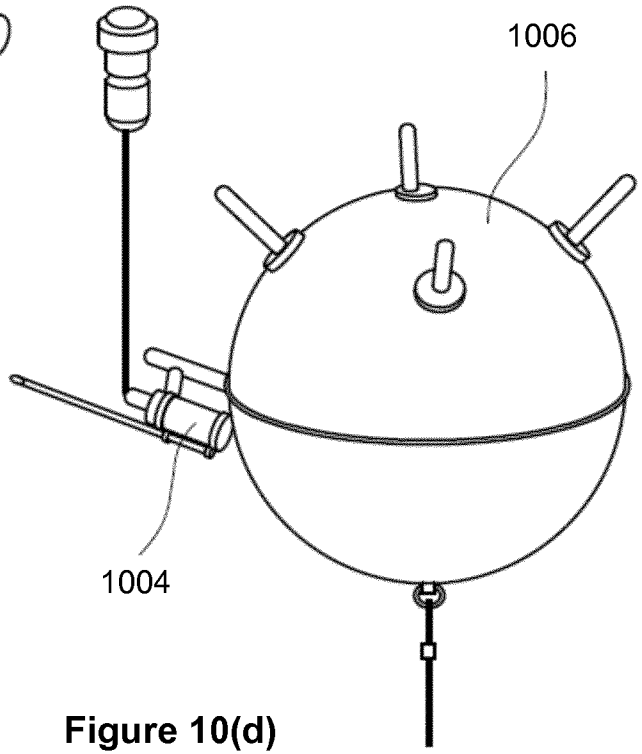

FIG. 9 shows the trigger and release unit 800 coupled to a telescopic arm 900 attached to an underwater ROV 902. The telescopic arm 900 enables the trigger and release unit 800 to be stowed within the ROV until the ROV makes the final approach to the ordnance to be cleared. The trigger and release unit 800 is coupled to a clearance charge 904. As can be seen, two further clearance charge systems, each with a trigger and release unit 800 are stowed within the ROV. As will now be appreciated, in use, when making the final approach to the ordnance to be cleared, the operator initiates a control signal to arm the trigger system of the trigger and release unit 800. Then the controller moves the ROV towards the ordnance and pushes the attachment device into contact with the ordnance which pushes the attachment device into the housing of the trigger and release unit to activate the trigger of the attachment device. Once attached, the operator then releases the attachment device, and therefore the clearance charge, from the trigger and release unit.

FIG. 10 shows a further example of three trigger and release units coupled to a single unmanned vehicle. In this example, the unmanned vehicle 1000 is an underwater remotely operated vehicle (ROV). The ROV is tethered, via tether 1002, to a surface vessel, such as a mine countermeasures vehicle. The ROV 1000 receives power and commands via the tether 1002. FIG. 10(*a*) shows the trigger release unit in the stowed position. That is to say, all three clearance charges are housed completely within the deployment unit and the trigger and release unit is shielded by the safety gates.

FIG. 10(*b*) shows a charge 1004 in one of the trigger and release units in the deployment position. The remote operator, situated on the surface vessel, has sent a command to the system controller to deploy the clearance charge. The linear actuator has therefore been activated, and the charge is moved forwards to the deployment position which in turns moves the safety gate, where provided, to the open position. In this configuration the charge is ready to be attached to the target ordnance.

FIGS. 10(*c*) and 10(*d*) show the clearance charge 1004 having been attached to a tethered mine 1006, and the ROV being manoeuvred away from the mine. Once the operator is satisfied that the charge 1004 is secured to the mine, the charge is released from the trigger and release unit by activating the position controlled piston to pump a further exact volume of hydraulic fluid to move the release sleeve to the second, released, position.

In use, the trigger and release unit 100, 800 combined with the unmanned vehicle 900, 1000, such as a remotely operated vehicle (ROV) may be operated as follows for different types of ordnance. It will of course be understood that the trigger and release unit and ROV may be operated in any other suitable manner:

Surface/Drifting Mine—Target Visual on Surface

Once the mine has been located, visual contact confirmed, and an approximate position established, the MCMV or Surface Support Craft, positions itself upwind and at approximately 150 m such that the target is clearly visual to a remote operator.

The ROV is made ready and the clearance charge is prepared in accordance with the recommended drill. The clearance charge is mounted within the trigger and release unit.

The ROV is launched with the clearance charge from the engaged side in accordance with Standard Operating Procedures (SOP's). When a tracking system, such as an acoustic tracking system (Sonar) is confirmed as operational, and on achieving a minimum range of 50 m from the MCMV, the ROV is taken in to manual control and brought to the surface. The remote operator confirms when the ROV is visual. At this point there will be approximately 100 m distance to run to the target ordnance.

The remote operator pilots the ROV towards the target giving approximate ranges. Some information may be received by the tracking system but this should be secondary to the visual primary means of closing the range to the target due to the potential ambiguity of such tracking systems information with the ROV at the surface.

When the ROV is approximately 30 m from the target, the ROV is stopped. When the remote operator has the target illuminated on the ROV Sonar, he maintains the range of ROV from target at no closer than 25 m. Consideration can be given to using a semi-automatic mode to maintain the constant range.

The MCMV, or surface support craft may then be manoeuvred to open the range from the target ordnance. The remote operator maintains the range of the ROV from the target ordnance at no closer than 25 m.

Shallow Moored Mine—Target not Visual on Surface

In this case, pre-requisites in terms of MCMV positioning are the same as for the engagement of a floating drifting mine which is visual.

The target ordnance is illuminated by the MCMVs sonar. The ROV vehicle is prepared as described above, and launched in a routine automatic run to engage the target ordnance. Again, the ROV is maintained at approximately 25 m from the target ordnance.

Procedure for Visual or Shallow-Moored Mines after ROV Reaches 25 m from Target Ordnance The MCMV is manoeuvred to a safe operating distance, such as 500 m. On completion, the remote operator of the ROV closes the range to the target ordnance using the ROV tracking system. The target ordnance may be engaged using the tracking system only, but the remote operator may be assisted by a camera in the final stages of the engagement run.

Following engagement and confirmation by the remote operator that the target is ordnance that requires neutralisation, the remote operator sends instructions to the trigger and release unit to arm the trigger portion by activating the position controlled piston to pump the volume of hydraulic fluid to move the trigger portion to the second, armed, position.

The remote operator then makes a final, slow speed, run to the target ordnance to attach the charge. At the same time, the attachment device is triggered by the force exerted by ROV pushing the attachment device onto the ordnance and moving the trigger sleeve to the second position, securing the charge to the target ordnance. Before initiating a retreat, the operator may use a camera on-board the ROV to check that the charge has been attached correctly. If the charge is attached correctly, it is released from the trigger and release unit by activating the position controlled piston to pump a further exact volume of hydraulic fluid to move the release sleeve to the second, released, position.

Once the ROV has made a complete retreat, the clearance charge may be remotely triggered to detonate, or it may be controlled by a remote line from the MCMV, such as NONEL shock tube, or it may operate on a timer system.

The ROV may then be recovered onboard the MCMV, or where the ROV comprises more than one trigger and release unit, a further ordnance may be targeted in the same way as described above.

Where more than one ordnance is targeted in a single sortie, the charges may be triggered to detonate only once all required charges have been deployed. The charges may be detonated simultaneously or, more preferably sequentially.

The embodiments and examples described above illustrate but do not limit the invention. It will be appreciated that other embodiments of the invention may be made and it is to be understood that the specific embodiments described herein are not intended to be limiting.

The invention claimed is:

1. A system for attaching a device to an object, comprising:

an attachment device for attaching the device to an object, the attachment device having a trigger for triggering activation of the attachment device;

a releasable coupling device for releasably coupling the attachment device to a deployment system, the releasable coupling device comprising:

a housing;

a trigger system, configured to trigger the attachment device trigger; and a retaining system, configured to releasably retain the attachment device;

wherein, the releasable coupling device is configured such that:

in a first configuration, the trigger system is in a disarmed state;

in a second configuration, the trigger system is in an armed state, such that movement of the attachment device relative to the housing of the releasable coupling device activates the trigger of the attachment device; and in a third configuration, the retaining system releases the attachment device;

wherein the trigger system comprises a trigger portion, slidable, relative to the housing, from a first position, in which the releasable coupling device is in the first configuration, to a second position, in which releasable coupling device is in the second configuration; and wherein the trigger system comprises an actuation portion, slidable, relative to the housing, between a first position, in which the releasable coupling device is in the first configuration, a second position, in which the releasable coupling device is in the second configuration, and a third position, in which releasable coupling device is in the third configuration.

2. The system for attaching a device to an object according to claim 1, wherein the trigger portion is slidable, relative to the actuation portion, from a first position, in which the releasable coupling device is in the first and second configurations, and a second position, in which the releasable coupling device is in the third configuration.

3. The system for attaching a device to an object according to claim 2, wherein the trigger portion is resiliently biased towards the first position relative to the actuation portion.

4. The system for attaching a device to an object according to claim 1, wherein the actuation portion comprises a visual indicator arranged to indicate when the actuation portion is in its first position.

5. The system for attaching a device to an object according to claim 1, wherein the actuation portion is configured to be hydraulically moved from the first position to the second position.

6. The system for attaching a device to an object according to claim 1, wherein the retaining system comprises at least two retaining arms, each arm having a distal end and a proximal end, the arms configured to pivot about the proximal ends from a first position in which the distal ends engage and retain the attachment device, to a second position in which the distal ends release the attachment device.

7. The system for attaching a device to an object according to claim 6, wherein the distal end of each retaining arm comprises a hook configured to engage with a recess provided in an outer surface of the attachment device.

8. The system for attaching a device to an object according to claim 6, wherein the retaining system further comprises a trigger sleeve configured to pivotably retain the proximal ends of the at least two retaining arms, the trigger sleeve being slidable, relative to the housing, between a first position and a second position, such that upon the releasable coupling device being in the second configuration movement of the trigger sleeve from the first position to the second position causes the trigger portion to activate the trigger of the attachment device.

9. The system for attaching a device to an object according to claim 8, wherein the trigger sleeve is resiliently biased towards the first position.

10. The system for attaching a device to an object according to claim 8, wherein the retaining system further comprises a release sleeve slidable, relative to the trigger sleeve, from a first position in which the release sleeve acts on the at least two retaining arms to maintain the at least two retaining arms in their first position, to a second position in which the at least two retaining arms are in their second position.

11. The system for attaching a device to an object according to claim 10, wherein the actuation portion is configured such that, upon the actuation portion sliding from its second position to its third position, it acts on the release sleeve to move the release sleeve from its first position to its second position.

12. The system for attaching a device to an object according to claim 10, wherein the release sleeve comprises at least two linear cam surfaces, and adjacent each distal end of the at least two retaining arms is provided a follower, each linear cam surface being configured to act on a corresponding follower of a retaining arm, such that upon the release sleeve moving from its first position to its second position each retaining arm is moved from its first position to its second position.

13. An unmanned underwater vehicle comprising a system for attaching a device to an object according to claim 1.

14. A system for attaching a device to an object, comprising:

an attachment device for attaching the device to an object, the attachment device having a trigger for triggering activation of the attachment device;

a releasable coupling device for releasably coupling the attachment device to a deployment system, the releasable coupling device comprising:

a housing;

a trigger system, configured to trigger the attachment device trigger; and a retaining system, configured to releasably retain the attachment device;

wherein, the releasable coupling device is configured such that:

in a first configuration, the trigger system is in a disarmed state;

in a second configuration, the trigger system is in an armed state, such that movement of the attachment device relative to the housing of the releasable coupling device activates the trigger of the attachment device; and in a third configuration, the retaining system releases the attachment device; and wherein the retaining system comprises at least two retaining arms, each arm having a distal end and a proximal end, the arms configured to pivot about the proximal ends from a first position in which the distal ends engage and retain the attachment device, to a second position in which the distal ends release the attachment device.

15. The system for attaching a device to an object according to claim 14, wherein the distal end of each retaining arm comprises a hook configured to engage with a recess provided in an outer surface of the attachment device.

* * * * *